US005262584A

United States Patent [19]

Shimada

[11] Patent Number: 5,262,584

[45] Date of Patent: Nov. 16, 1993

[54] ELECTRONIC MUSICAL INSTRUMENT WITH RECORD/PLAYBACK OF PHRASE TONES ASSIGNED TO SPECIFIC KEYS

[75] Inventor: Yoshihisa Shimada, Hamamatsu, Japan

[73] Assignee: Kabushiki Kaisha Kawai Gakki Seisakusho, Shizuoka, Japan

[21] Appl. No.: 921,650

[22] Filed: Jul. 30, 1992

[30] Foreign Application Priority Data

Aug. 9, 1991 [JP] Japan ..... 3-224900

[51] Int. Cl.[5] ..... G10H 1/18; G10H 1/38; G10H 1/42

[52] U.S. Cl. ..... 84/609; 84/611; 84/613; 84/615; 84/626; 84/DIG. 12; 84/DIG. 22

[58] Field of Search ..... 84/609-615, 84/626, 633-638, DIG. 7, DIG. 12, DIG. 22

[56] References Cited

U.S. PATENT DOCUMENTS 5,063,820 11/1991 Yamada ..... 84/633 X
5,138,926 8/1992 Stier et al. ..... 84/615

*Primary Examiner*—Stanley J. Witkowski

[57] ABSTRACT

An electronic musical instrument, in which a phrase for about one bar is assigned to each of keys across two octaves, a note data string of each phrase is read out from a memory in accordance with a one-finger key operation, and corresponding tones are generated. Key numbers, key depression velocities, and key depression timings of a series of key operations in a phrase play mode are recorded in a recording medium. In a playback mode, a note data string of a phrase corresponding to a playback key number is read out from the memory. Tone generation strength data in the note data are multiplied with the playback key depression velocity, thus obtaining a modified note data string. Playback tones of a phrase play close to an actual play can be generated by modifying key depression strengths of phrase tones pre-programmed in the memory.

7 Claims, 15 Drawing Sheets

ELECTRONIC MUSICAL INSTRUMENT WITH RECORD/PLAYBACK OF PHRASE TONES ASSIGNED TO SPECIFIC KEYS

BACKGROUND OF THE INVENTION

1. Field of the Invention

The present invention relates to an auto-play apparatus and, more particularly, to an auto-play apparatus, which allows an easy adlib play by assigning different phrases for about one bar to a plurality of keys, and is suitably used in an electronic musical instrument, which can record or play back the adlib play.

2. Description of the Related Art

In general, an electronic keyboard (e.g., an electronic piano) comprises an auto-accompaniment function including a rhythm auto-accompaniment mode, a chord-/bass auto-accompaniment mode, and the like. In some electronic musical instruments, different phrases each for about one bar are assigned to a plurality of keys, and these phrases are selectively read out by one-finger key operations, thereby obtaining an adlib-like play effect upon coupling of a series of phrases (so-called a one-finger adlib play function).

Furthermore, another electronic musical instrument has a recording/playback function. In this recording/-playback function, data such as key numbers, step times (tone generation timing data), gate times (tone durations), key depression velocities, and the like of depressed keys are recorded, and tones are generated on the basis of playback key depression data.

When the above-mentioned adlib phrase play is performed using a conventional electronic keyboard, or the like, the tone volume has a fixed value, which is determined on the basis of velocity values of pre-programmed note data. Therefore, even when an adlib-like play is performed, since the tone volume is fixed, the adlib phrase play cannot have a sufficient variation. Therefore, when an adlib phrase play portion is played back, an adlib play different from intended emotions is unexpectedly played back, resulting in uneasy feeling.

SUMMARY OF THE INVENTION

It is an object of the present invention to provide an auto-play apparatus, which can vary the tone volume of playback adlib phrase play tones according to the key operation strengths, so that even a beginner can perform an adlib play with a full range of expressions with one finger, and the adlib play can be played back without uneasy feeling.

An auto-play apparatus according to the present invention comprises note data storage means for storing note data strings of a plurality of different short phrases in correspondence with key numbers, tone generation means for generating tones on the basis of the note data string read out from the note data storage means, recording/playback means for recording key-ON data containing key number data and key-ON strength data, means for reading out the note data string of the short phrase corresponding to the key number in the key-ON data played back from the recording/playback means, and modification means for multiplying tone generation strength data of the note data string read out from the note data storage means with the key-ON strength data in the played back key-ON data to obtain a modified note data string, and supplying the modified note data string to the tone generation means.

The tone volume of playback adlib phrase play tones can be varied according to the key operation strengths. Thus, even a beginner can perform an adlib play with a full range of expressions with one finger. When both normal key-ON data and adlib key-ON data are recorded or played back, a playback play operation close to an actual play can be performed without uneasy feeling.

DETAILED DESCRIPTION OF THE PREFERRED EMBODIMENT

Figure 1:
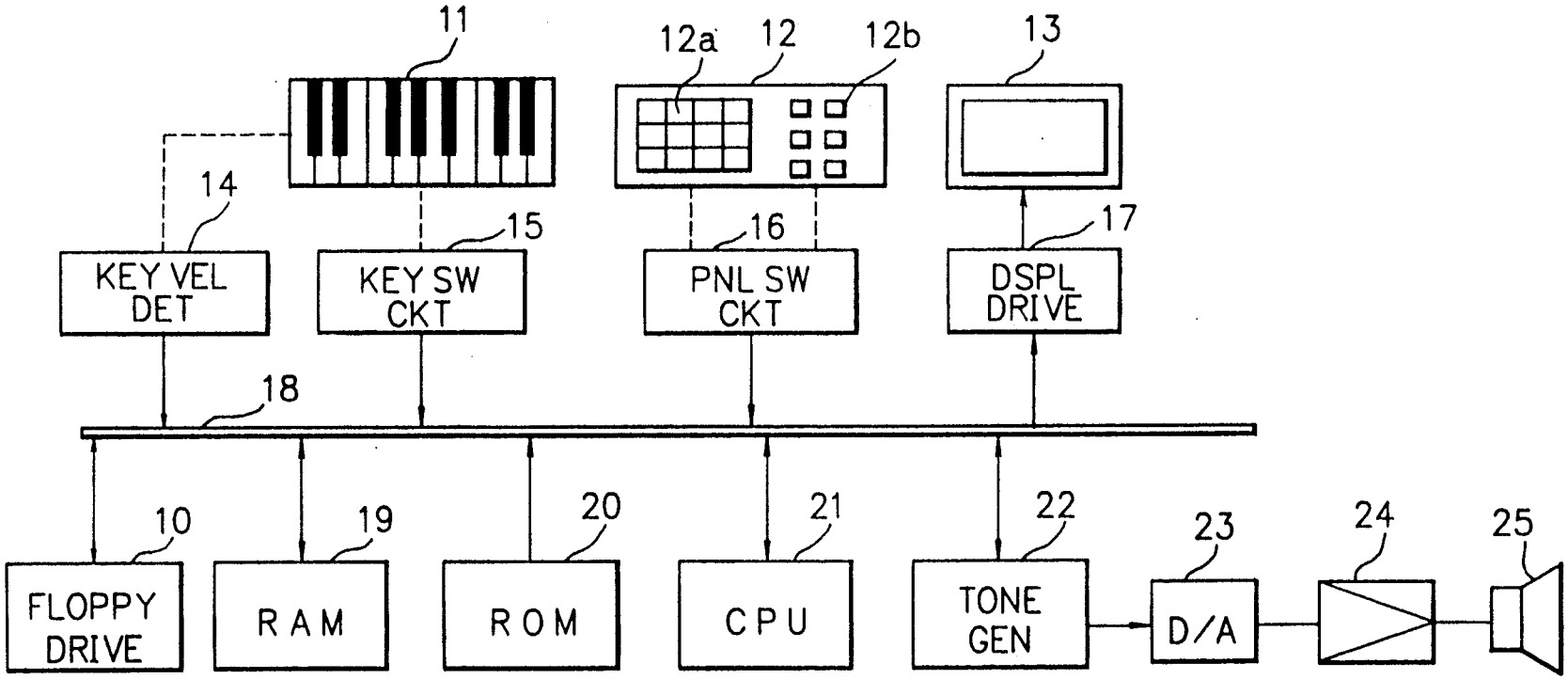
FIG. 1 is a block diagram of an electronic musical instrument according to an embodiment of a phrase play apparatus of the present invention.

FIG. 1 is a block diagram showing principal part of an electronic musical instrument according to an embodiment of the present invention. This electronic musical instrument comprises a keyboard 11, an operation panel 12, a display 13, a key depression velocity (key velocity) detection circuit 14, and the like.

The circuit portion of the electronic musical instrument comprises a floppy disk drive 10, and a microcomputer including a CPU 21, a ROM 20, and a RAM 19, which are connected through a bus 18. The CPU 21 detects operation information of the keyboard 11 from a key switch circuit 15 connected to the keyboard 11, and detects operation information of panel switches from a panel switch circuit 16 connected to the operation panel 12.

The rhythm and type of instrument selected by the operation panel 12 are displayed on the basis of display data supplied from the CPU 21 to the display 13 through a display drive circuit 17.

The CPU 21 supplies note information corresponding to keyboard operations, and parameter information such as a rhythm, a tone color, and the like corresponding to panel switch operations to a tone generator 22. The tone generator 22 reads out PCM tone source data from the ROM 20 on the basis of the input information, processes the amplitude and envelope of the readout data, and outputs the processed data to a D/A converter 23. A tone signal digital/analog-converted by the D/A converter 23 is supplied to a loudspeaker 25 through an amplifier 24.

The ROM 20 stores auto-accompaniment data. The CPU 21 reads out auto-accompaniment data corresponding to an operation of an auto-accompaniment selection button on the operation panel 12 from the ROM 20, and supplies the readout data to the tone generator 22. The tone generator 22 reads out waveform data such as chord, bass, drum tones, and the like from the ROM 20, and supplies the readout data to the D/A converter 23. Therefore, auto-accompaniment chord, bass, and drum tones are obtained from the loudspeaker 25 together with tones corresponding to key operations.

Data played back from a recording medium (floppy disk) in the floppy disk drive 10 is stored in the RAM 19.

Figure 2:
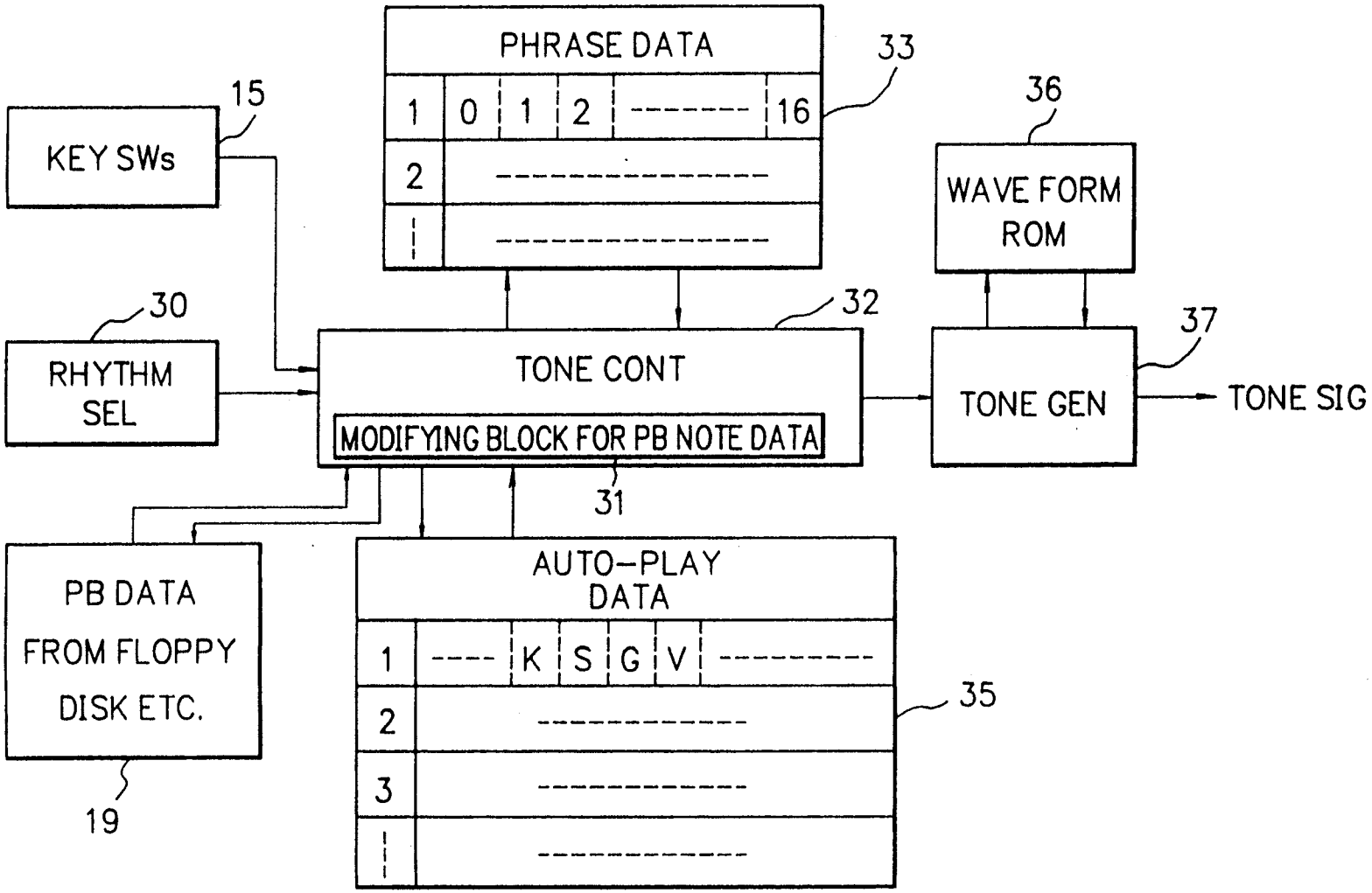
FIG. 2 is a block diagram showing elemental features of the phrase play apparatus of the present invention.

FIG. 2 is a block diagram showing the elemental features of this embodiment. A rhythm selection unit 30 comprises ten-key switches 12*a* (FIG. 1) provided to the operation panel 12. The operation panel 12 is also provided with selection buttons 12*b* for selecting various modes such as a rhythm accompaniment mode, an auto chord accompaniment mode, an adlib phrase play mode, and the like.

Figure 3:
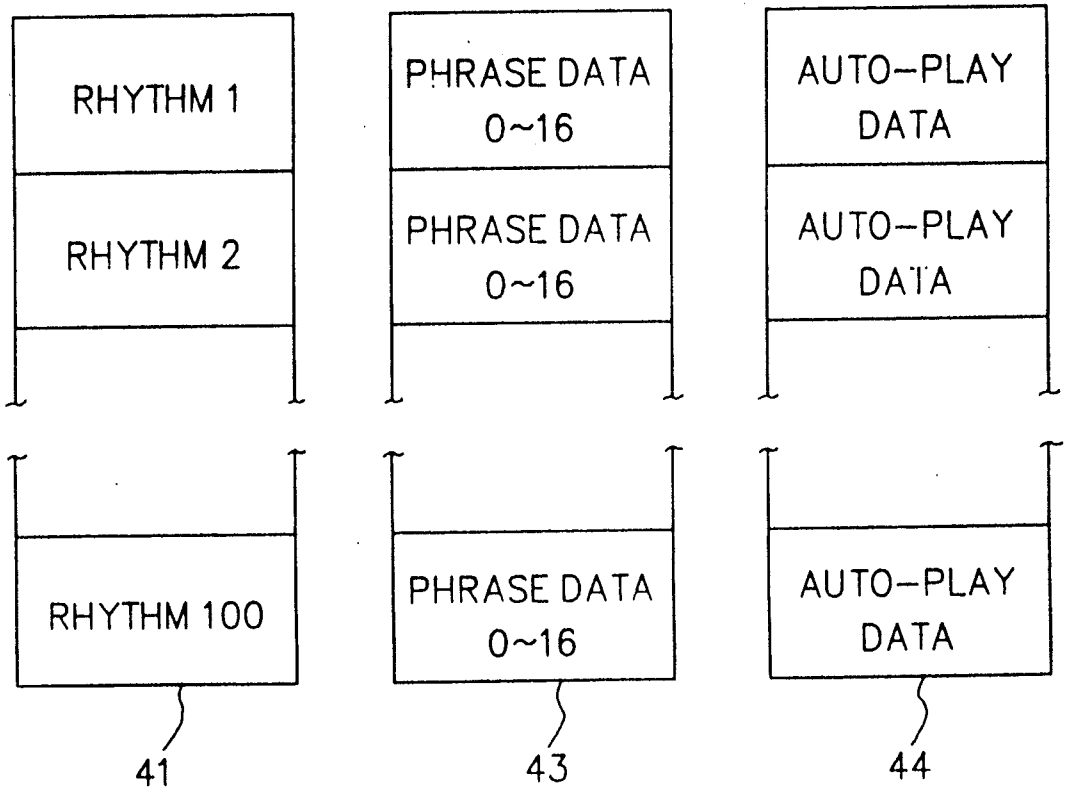
FIG. 3 shows the format of auto-play data.

A phrase data memory 33 connected to a tone controller 32 is allocated on the ROM 20, and has phrase data tables 43 each consisting of 17 different key phrase data assigned to 17 keys (0 to 16) in units of rhythms, as shown in FIG. 3.

Each key phrase data includes play pattern data (address information) for reading out note data for about one bar from a note data memory. In the adlib phrase play mode, phrases are assigned to specific 17 keys in correspondence with the selected rhythm. When one key is depressed, corresponding phrase data is read out from the phrase data memory 33. Based on the readout data, note data constituting a 4-beat phrase are read out from an auto-play data memory 35, and are played back. Since all the phrases corresponding to the 17 keys are different from each other, an adlib play can be easily performed by operating keys at, e.g., every 4-beat timing.

The tone controller 32 reads out auto-play data from the auto-play data memory 35 on the basis of play pattern data or phrase data, and modifies the readout auto-play data with data for designating a tone volume, a tone color, an instrument, and the like, and supplies the modified data to a tone generator 37. The tone controller 32 has a playback note data modifying block 31, which varies the tone volume of playback adlib phrase play tones according to the key operation velocities, as will be described later.

The auto-play data memory 35 is allocated on the ROM 20, and comprises tables 44 for storing auto-accompaniment note data strings for chord, bass, drum parts, and the like in units of rhythms, as shown in FIG. 3 showing the format of auto-play data. Each note data includes key (interval) number data, tone generation timing data, tone duration data, tone volume data, and the like. Note that the ROM 20 comprises tables 41 for storing rhythm numbers in units of rhythms, as shown in FIG. 3.

The tone generator 37 reads out a corresponding PCM tone source waveform from the waveform ROM 36 on the basis of note data from the tone controller 32, and forms tone signals. Thus, auto-accompaniment tones can be obtained.

Figure 4:
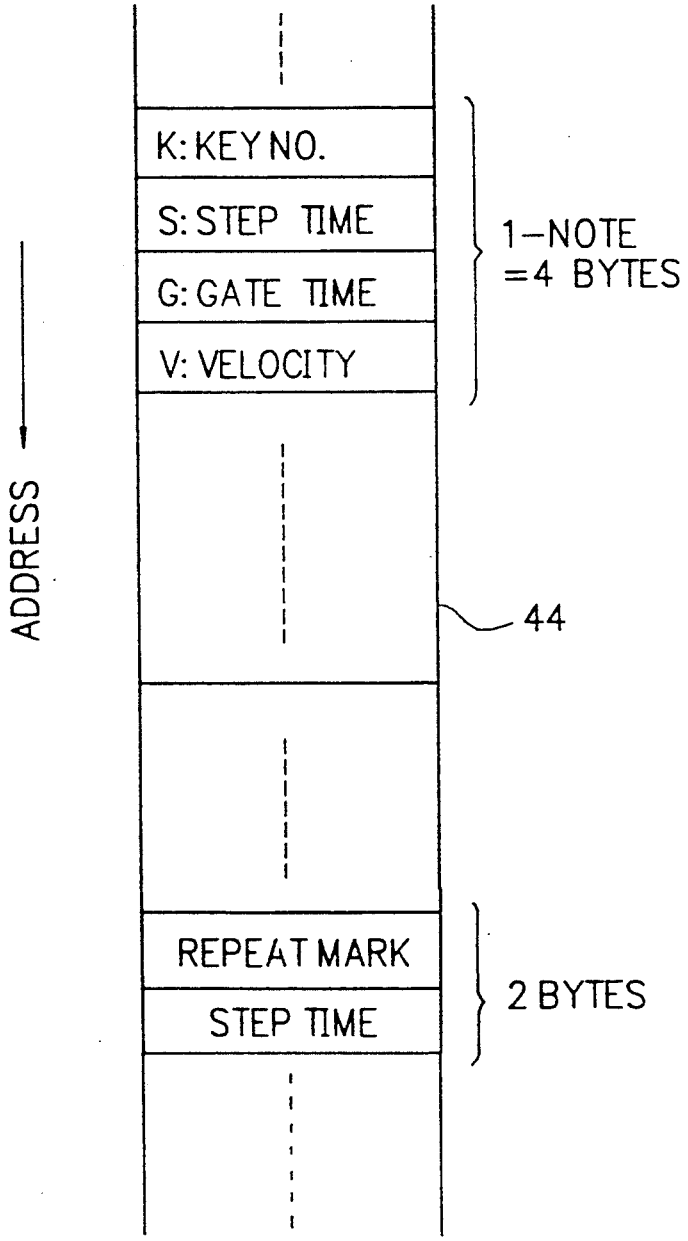
FIG. 4 shows the architecture of note data read out by auto-play pattern data.

FIG. 4 partially shows note data 44 accessed through auto-play pattern data or phrase data. One tone of the note data includes four bytes, i.e., a key number K, a step time S, a gate time G, and a velocity V.

The key number K indicates a scale, the step time S indicates a tone generation timing, the gate time G indicates a tone generation duration, and the velocity V indicates the tone volume (key depression pressure) of a tone. In addition to these data, the note data includes tone color data, a repeat mark of a note pattern, and the like.

Note data are sequentially read out from the auto-play data memory 35 in units of four bytes from an address indicated by phrase data. The tone controller 32 shown in FIG. 2 performs read address control of the memory on the basis of phrase data, and supplies readout note data to the tone generator 37.

Figure 5:
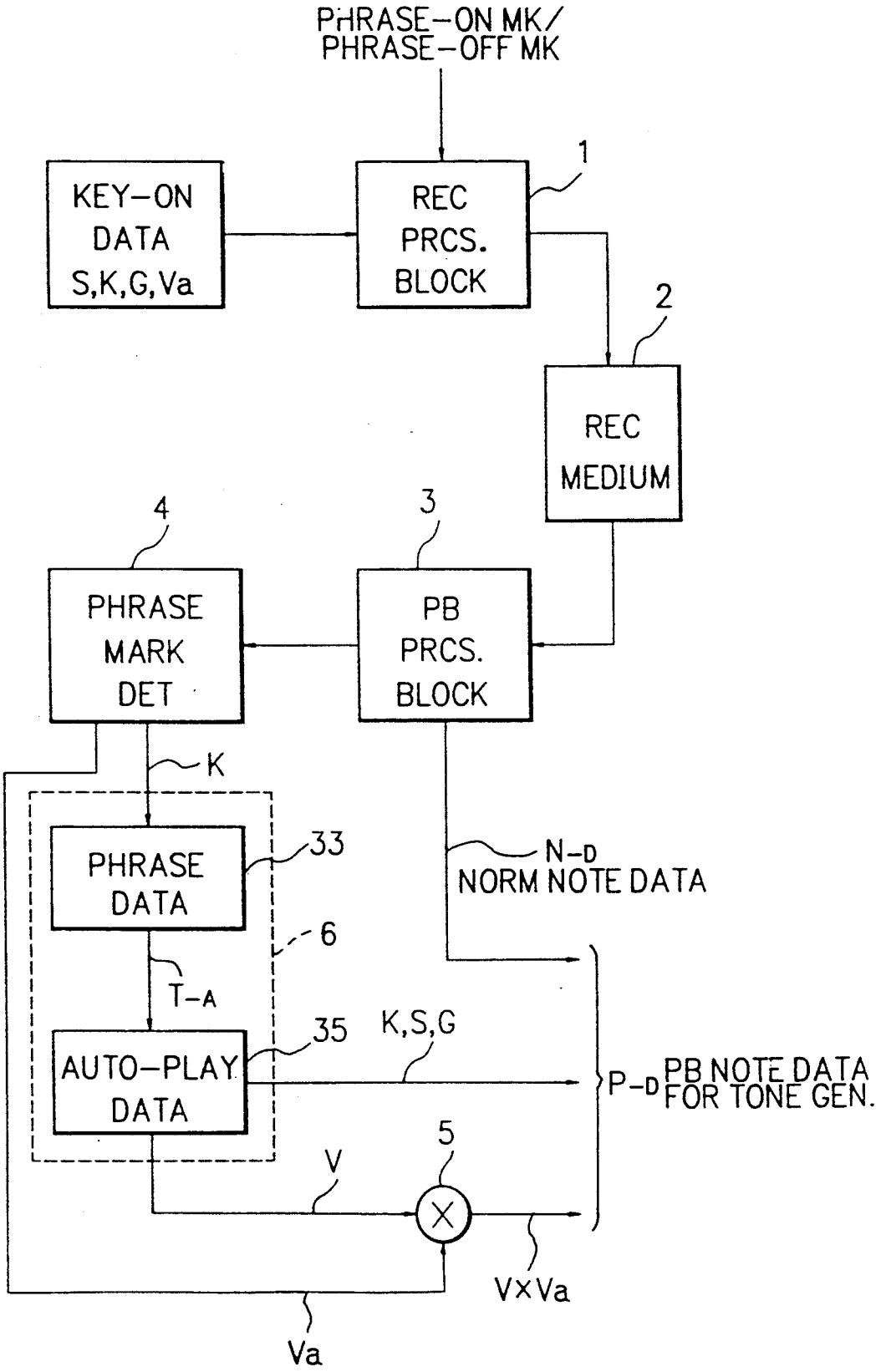
FIG. 5 is a block diagram showing principal functions of the present invention.

FIG. 5 is a functional block diagram of this embodiment. As shown in FIG. 5, key-ON data such as a key number K, a step time S, a gate time G, a key velocity Va corresponding to a key depression speed, and the like are supplied to a recording (REC) processing block 1.

The REC processing block 1 receives a phrase-ON mark and a phrase-OFF mark in a phrase play mode, and these data are written in a recording medium 2 such as a floppy disk together with key data.

In a playback mode, key-ON data written in the recording medium 2 are read out, and are supplied to a playback (PB) processing block 3. Normal note data $N_{-D}$, which do not correspond to an adlib phrase, are directly output to the tone generator as tone generation PB note data $P_{-D}$.

On the other hand, key-ON data associated with an adlib phrase play are detected as phrase key-ON data by a phrase mark detection circuit 4. Upon detection of a phrase-ON mark, the phrase mark detection circuit 4 outputs a PB key number K, a key velocity Va, and the like. The PB key number K is supplied to a note data memory 6, and a top address $T_{-A}$ of auto-play data of a corresponding phrase is read out from the phrase data memory 33 (table).

The top address $T_{-A}$ is supplied to the auto-play data memory 35, thereby reading out key numbers K, step times S, gate times G, and the like of notes constituting the phrase. These data are output as tone generation PB note data $P_{-D}$ to the tone generator like in the normal note data $N_{-D}$.

On the other hand, a fixed velocity V of note data read out from the auto-play data memory 35 is supplied to a multiplier 5.

The multiplier 5 receives the velocity value Va of PB key-ON data from the phrase mark detection circuit 4. Therefore, the multiplier 5 multiplies 8 bits of the velocity data V of the phrase, and 8 bits of the key velocity data Va, thus generating 16-bit data.

Upper 8 bits of the generated 16-bit data are multiplied with a compensation factor (e.g., the compensation factor=2), and the product data is used as velocity data. Thus, PB adlib phrase play tones can be varied according to key operations. The product signal $V \times Va$ is output to the tone generator.

In this manner, when adlib phrase key-ON data recorded in the recording medium 2 is played back, and is output to the tone generator 22, PB adlib phrase play tones can be varied in correspondence with the key operation velocities. Note that one phrase includes four notes, and a key operation is performed once per phrase. Therefore, the velocity value of the key operation is commonly multiplied with the velocity values of four notes.

FIGS. 6 to 15 are flow charts showing auto-play control based on phrase data.

Figure 6:
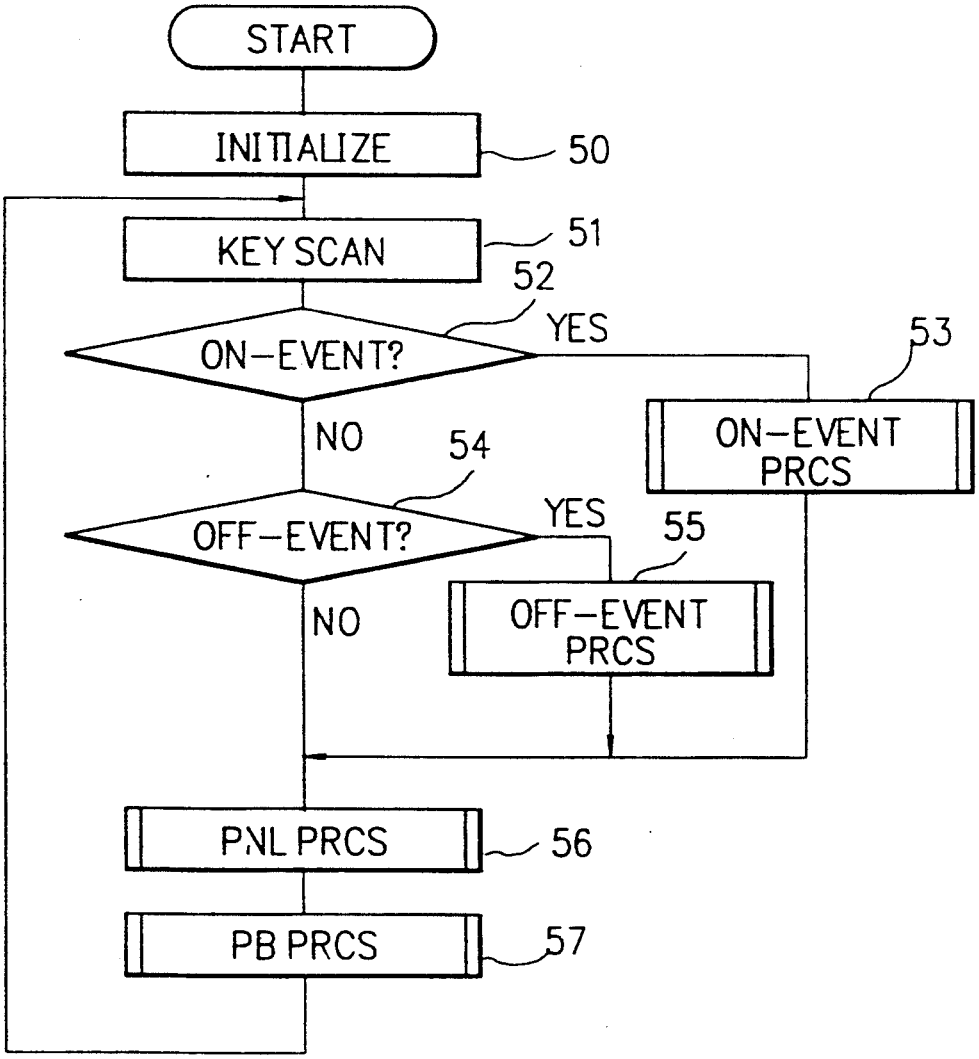
FIG. 6 is a flow chart showing auto-play control.

In step 50 in FIG. 6, initialization is performed. In step 51, scan detection processing for operations on the keyboard 11 is performed. If a key ON event is detected, the flow advances from step 52 to step 53 to execute ON event processing; if a key OFF event is detected, the flow advances from step 54 to step 55 to execute OFF event processing.

If no key event is detected, operation detection processing of the panel is executed in step 56. Furthermore, in step 57, auto-play processing (PB processing) of tones is performed, and the flow then loops to step 51.

Figure 7:
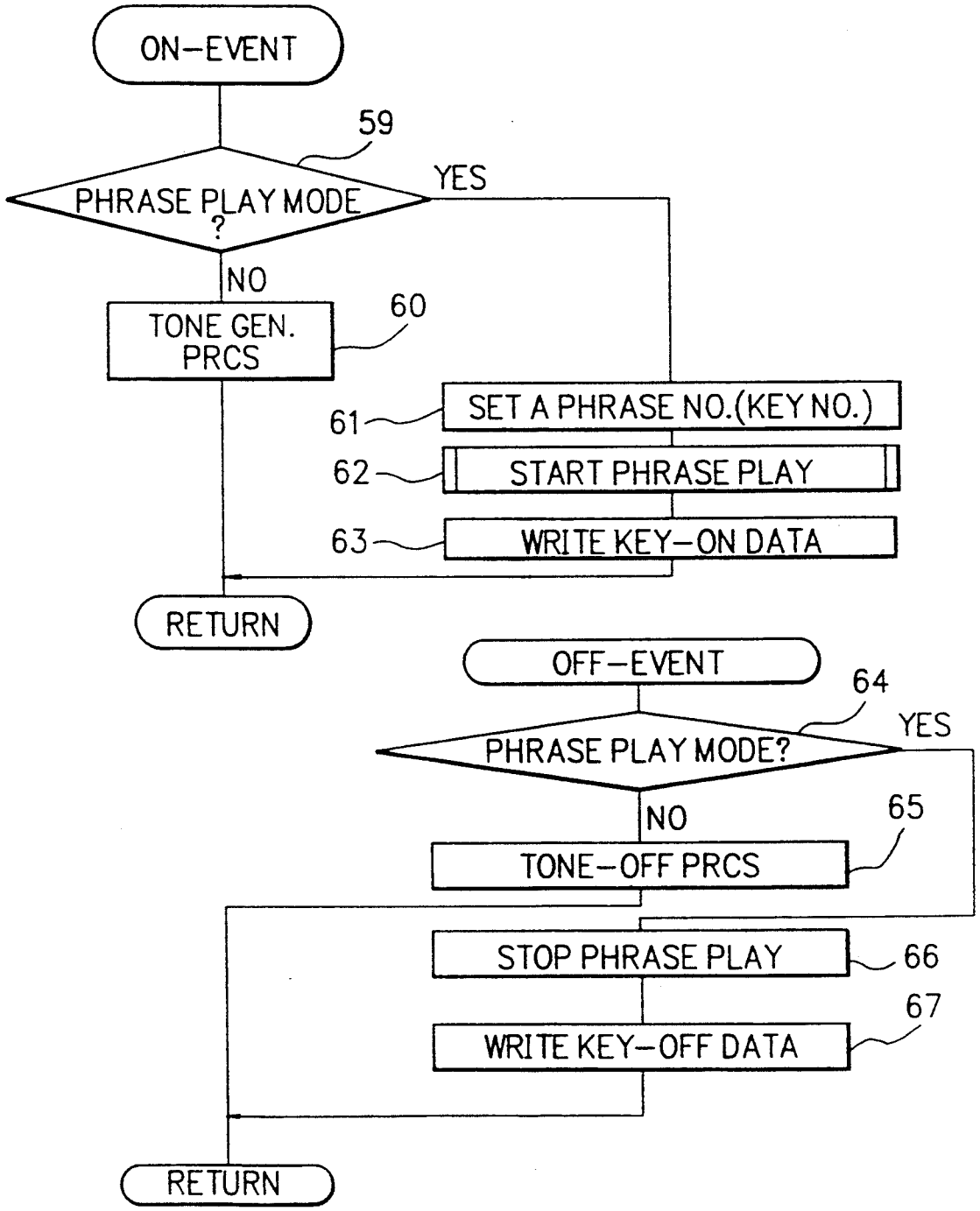
FIG. 7 is a flow chart showing auto-play control.

FIG. 7 shows key ON and OFF event processing operations. In the case of an ON event, in step 59, it is checked if a phrase play mode is selected. If NO in step 59, tone generation processing is performed in step 60.

If YES in step 59, a phrase number (key number) is set in step 61. In step 62, a phrase play is started, and in step 63, key-ON data is written in the floppy disk.

In the OFF event processing shown in FIG. 7, it is checked in step 64 if the phrase play mode is selected. If NO in step 64, tone OFF processing is performed in step 65. If YES in step 64, the phrase play is stopped in step 66. In step 67, key-OFF data is written in the floppy disk.

Figure 8:
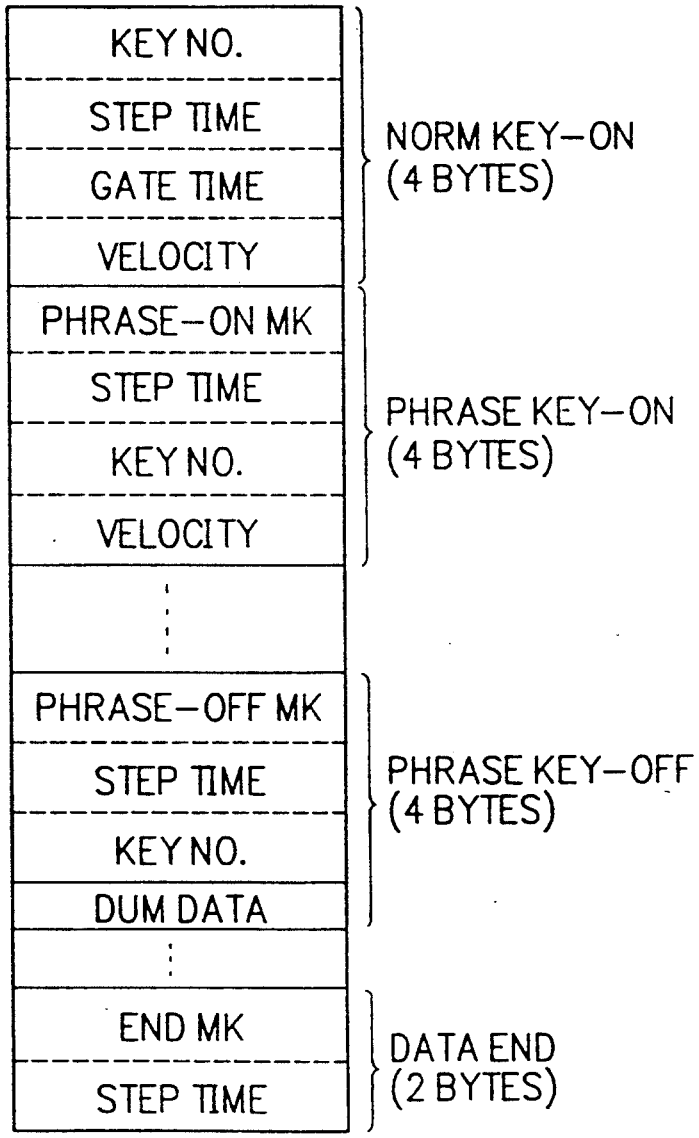
FIG. 8 shows the architecture of recording note data.

FIG. 8 shows the architecture of recording data. Normal key-ON data includes four bytes, i.e., a key number, a step time, a gate time, and a velocity.

Phrase key-ON data in the phrase play mode consists of includes four bytes, i.e., a phrase-ON mark, a step time, a key number, and a velocity.

Phrase key-OFF data includes a phrase-OFF mark, a step time, a key number, and one-byte dummy data, thus constituting 4-byte data.

Data at the data end is constituted by an end mark and a step time.

Figure 9:
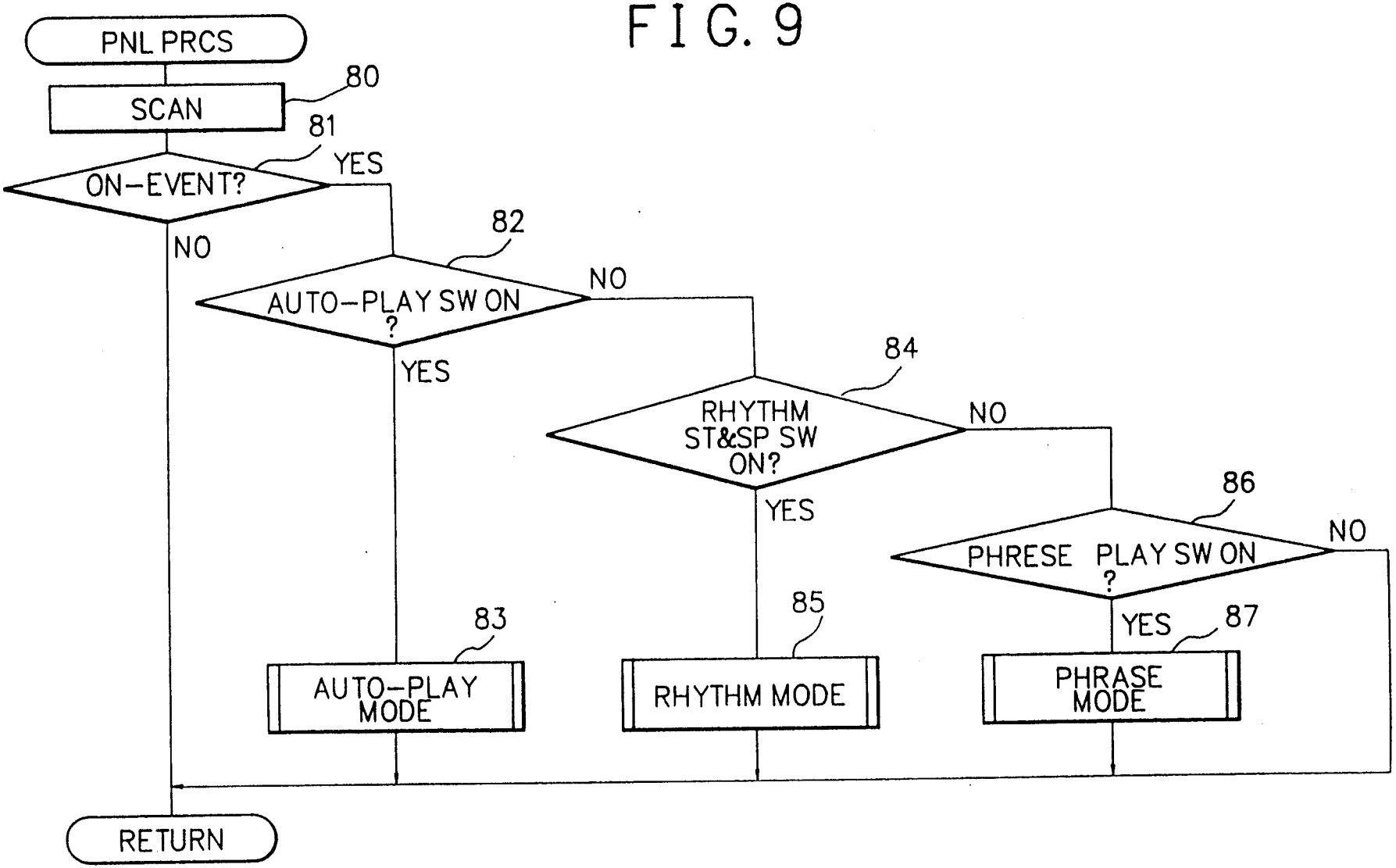
FIGS. 9 to 15 are flow charts showing auto-play control.

FIG. 9 shows panel processing. In step 80, scan processing is performed. If an ON event is detected, the flow advances from step 81 to steps 82, 84, and 86 (switch detection processing).

When an auto-play switch of the selection switches 12*a* of the operation panel 12 is turned on, auto-play mode processing in step 83 is executed. When a rhythm start/stop switch is turned on, rhythm mode processing in step 85 is executed. When a phrase play switch is turned on, phrase mode processing in step 87 is executed. In these processing operations, corresponding flags are set. Upon completion of these processing operations, the flow advances to ① in FIG. 10.

Figure 10:
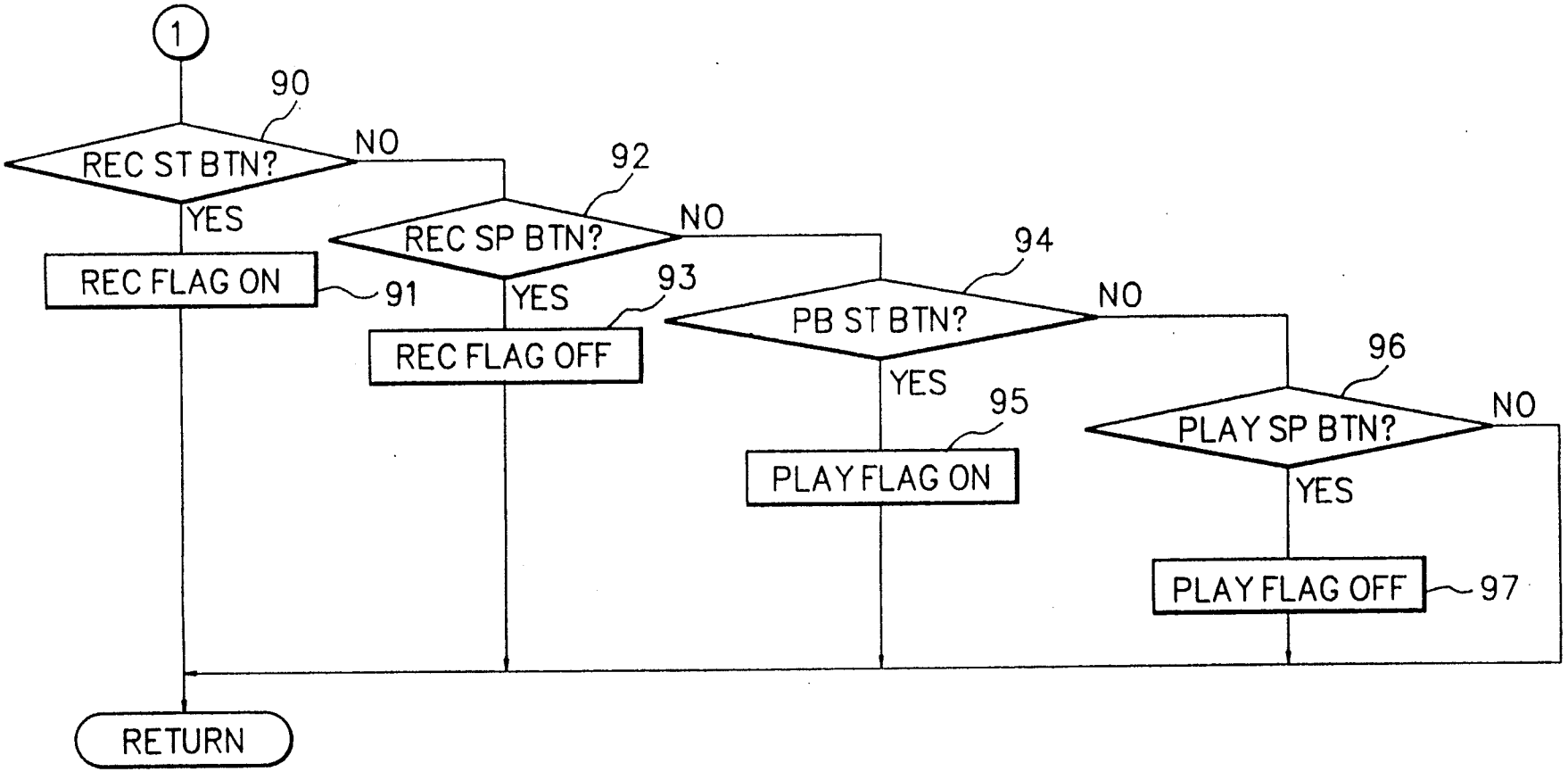

FIG. 10 shows the continuation of the panel processing. In step 90, it is checked if a REC start button is depressed. If YES in step 90, a REC flag is set in an ON state; otherwise, it is checked in step 92 if a REC stop button is depressed.

If YES in step 92, the REC flag is set in an OFF state in step 93; otherwise, it is checked in step 94 if a PB start button is depressed.

If YES in step 94, the flow advances to step 95 to set a play flag in an ON state. If NO in step 94, the flow advances to step 96 to check if a play stop button is depressed.

If YES in step 96, the flow advances to step 97 to set the play flag in an OFF state. If NO in step 96, the flow returns.

Figure 11:
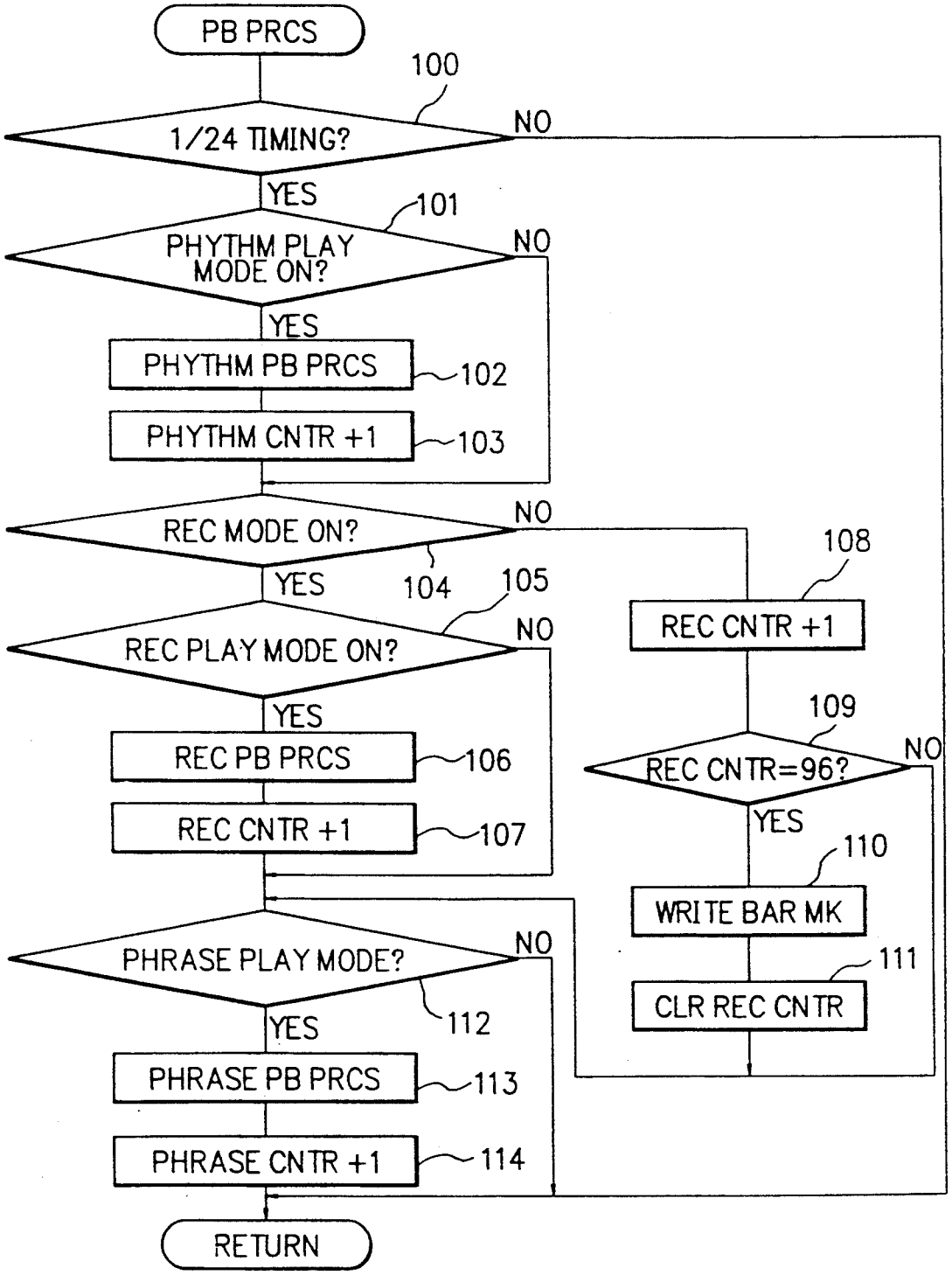

FIG. 11 shows the auto-play (PB) processing routine in step 57 in FIG. 6. In step 100, it is checked if a 1/24 timing is set. If NO in step 100, the flow returns. If it is determined in step 100 that the timing corresponds to a timing 1/24 a quarter note, the flow advances to step 101 to check if a rhythm play mode is ON.

If NO in step 101, the flow advances to step 104 to check if a REC mode is ON. If YES in step 101, the flow sequentially advances to steps 102 and 103 to execute rhythm PB processing, and to increment the count value of a rhythm counter by one. Thereafter, the flow then advances to step 104.

In step 104, it is checked if the REC mode is ON. If NO in step 104, the flow advances to step 105. In step 105, it is checked in step 106 if a REC play mode is ON. If YES in step 105, REC PB processing is performed in step 106, and the count value of a REC counter is incremented by one in step 107. Thereafter, the flow advances to step 112.

If it is determined in step 104 that the REC mode is OFF, the flow advances to step 108 to increment the count value of the REC counter by one. Thereafter, the flow advances to step 109 to check if the count value of the REC counter is "96" (end of a bar). If YES in step 109, a bar mark is written in step 110, and the REC counter is cleared in step 111. Thereafter, the flow advances to step 112. If it is determined in step 109 that the count value is not "96", the flow jumps to step 112.

In step 112, it is checked if a play mode is a phrase play mode. If YES in step 112, phrase PB processing is performed in step 113. Thereafter, in step 114, the count value of a phrase counter is incremented by one. If it is determined in step 112 that the play mode is not the phrase play mode, the flow directly returns.

Figure 15:
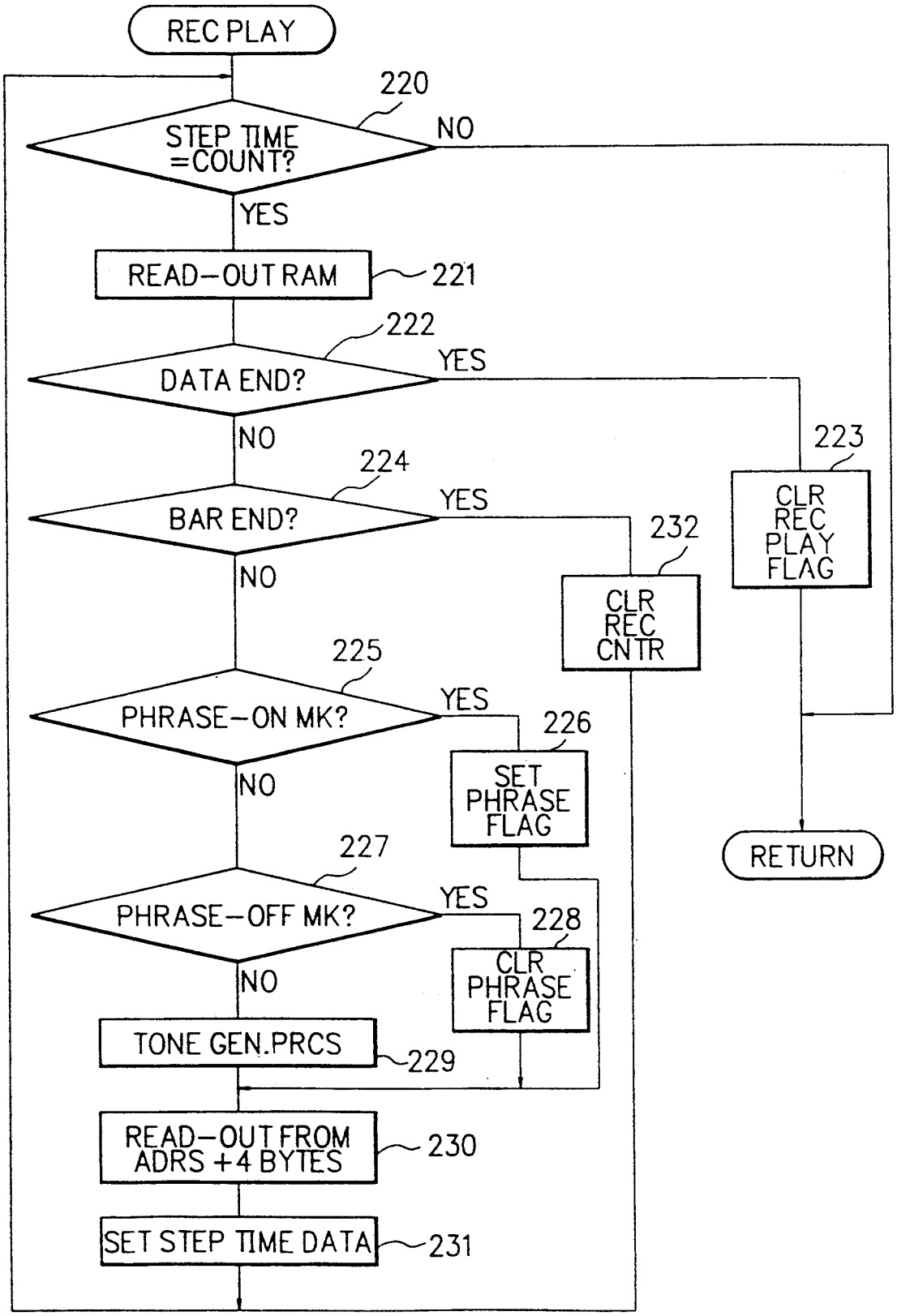

FIG. 15 shows processing (step 106 in FIG. 11) when recorded key-ON data are played back. In step 220, it is checked if the count value of a time-base counter coincides with a step time. If NO in step 220, the flow returns.

If it is determined in step 220 that the count value coincides with the step time, the flow advances to step 221. In step 221, data are played back from the floppy disk, and key-ON data stored in the RAM 19 are read out.

Upon completion of the read-out operation, it is checked in step 222 if data reaches a data end. If YES in step 222, the flow advances to step 223 to clear the REC PB flag, and thereafter, the flow returns.

If NO in step 222, the flow advances to step 224 to check if data reaches a bar end. If YES in step 224, the flow advances to step 232 to clear the REC counter.

If NO in step 224, a phrase-ON mark is checked in step 225. If a phrase-ON mark is detected in PB data, the flow advances to step 226 to set a phrase flag, and thereafter, the flow advances to step 230.

However, if no phrase-ON mark is detected, the flow advances to step 227 to check a phrase-OFF mark. If a phrase-OFF mark is detected, the flow advances to step 228 to clear the phrase flag, and thereafter, the flow advances to step 229.

If neither a phrase-ON mark nor a phrase-OFF mark are detected in steps 225 and 227, since PB data are normal key-ON data, tone generation processing of corresponding notes is performed in step 229. Upon completion of the tone generation processing, the read address is advanced by four bytes in step 230, and the next step time is set in a buffer in step 231. The flow then returns to step 220 to repeat the series of processing operations up to the REC end.

Figure 12:
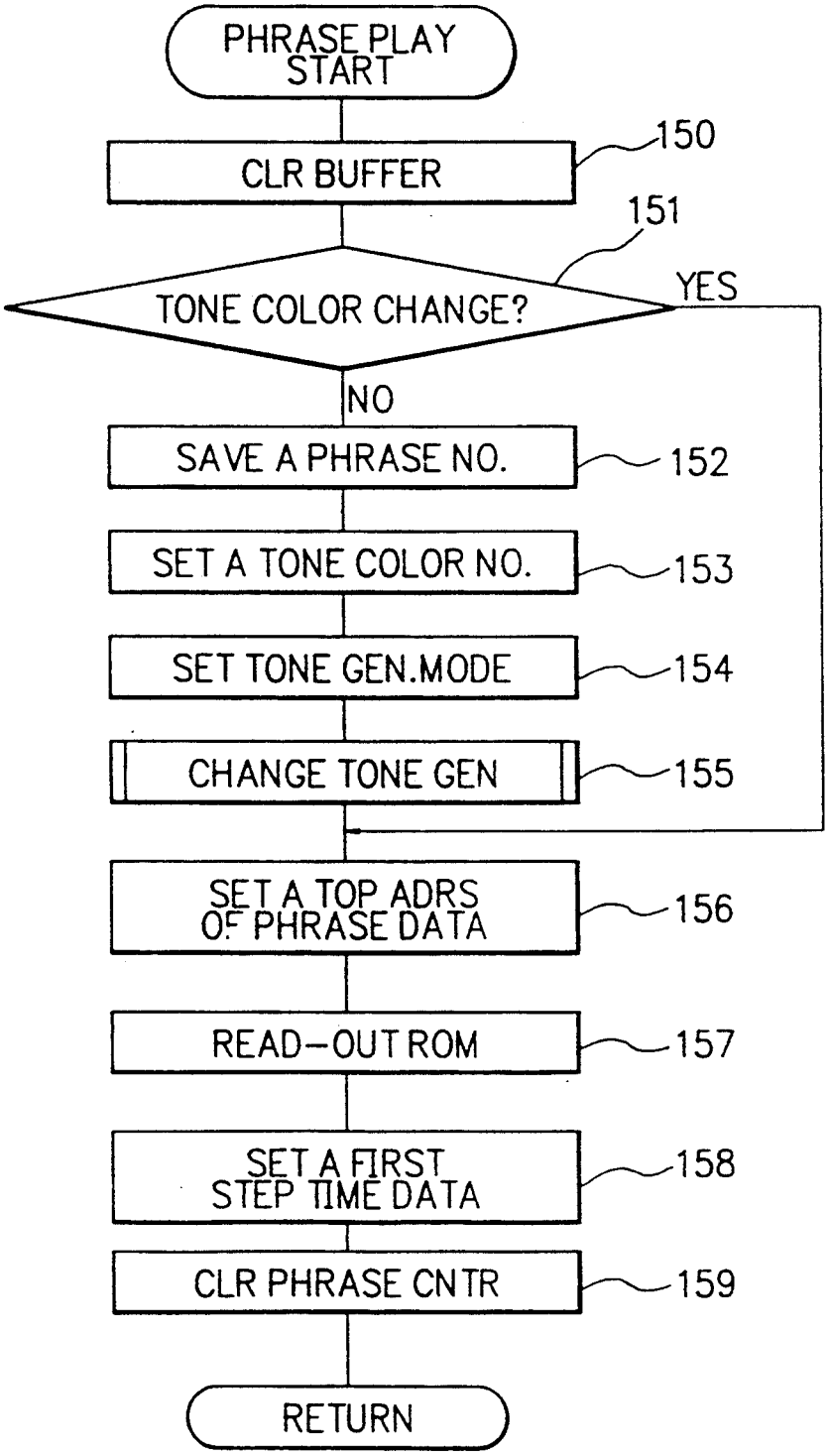
Figure 13:
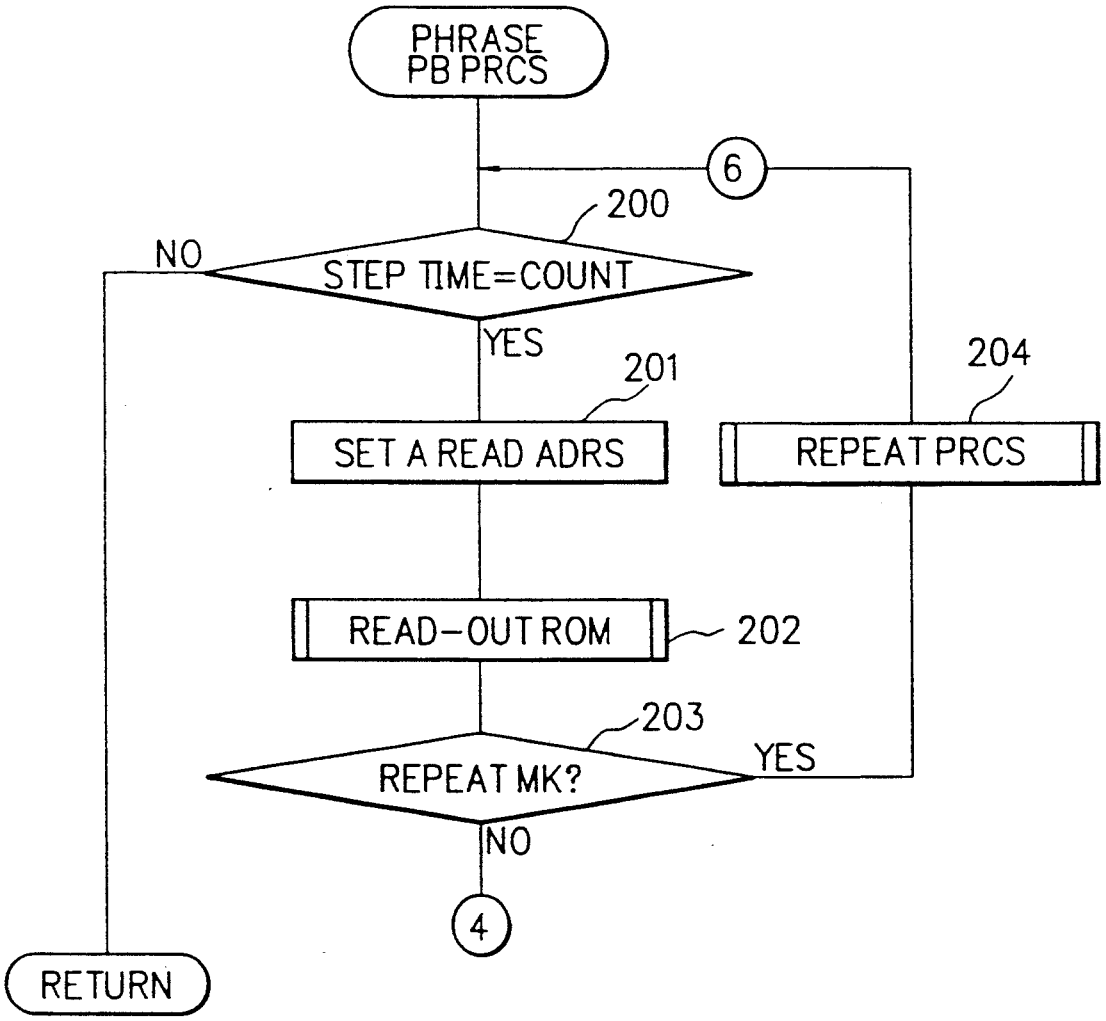
Figure 14:
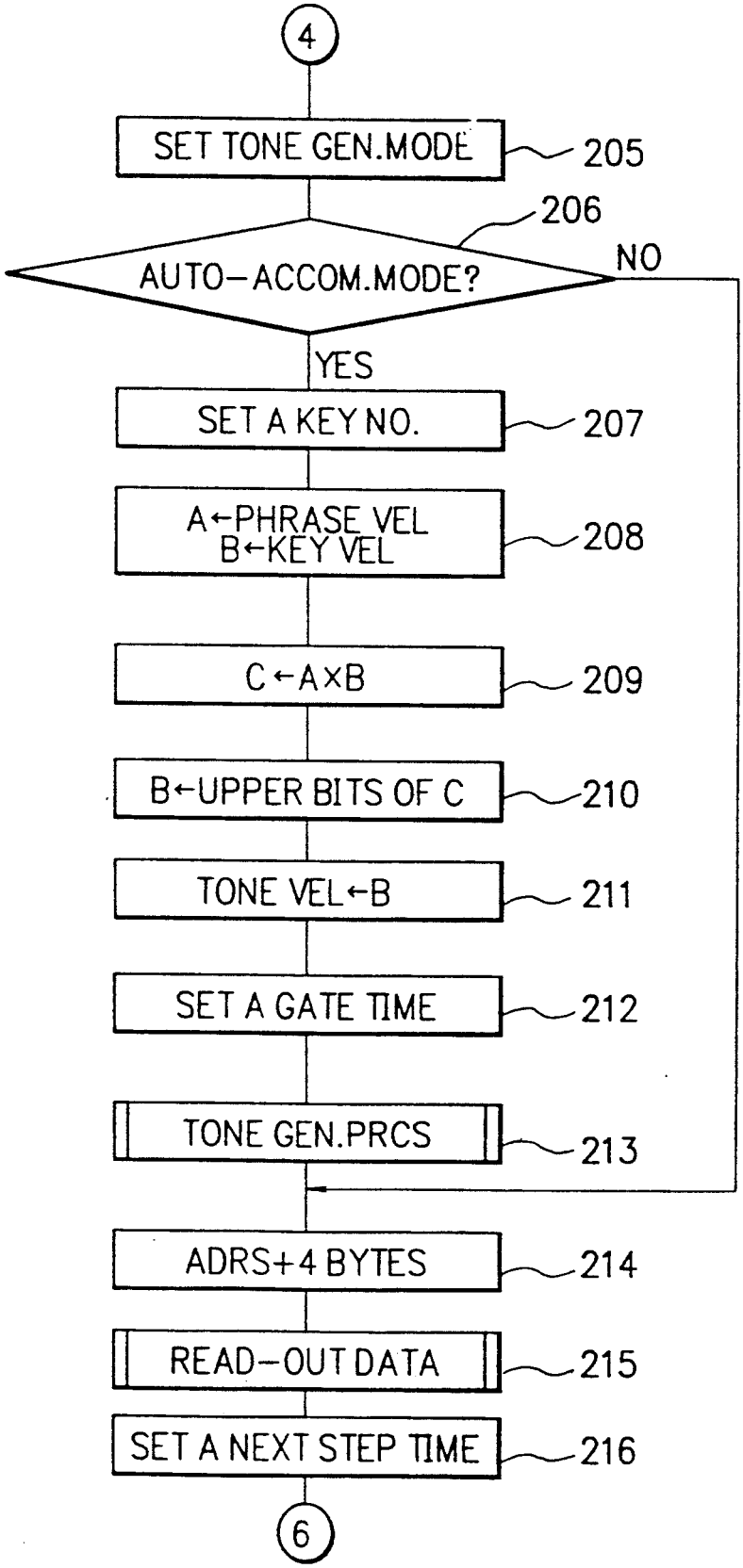

FIGS. 12 to 14 show details of the phrase PB processing in step 113 in FIG. 11.

FIG. 12 shows processing when a phrase play is started. In step 150, the buffer is cleared. In step 151, it is checked if the tone color is changed. If NO in step 151, a phrase number is fetched in step 152. A tone color number is set in step 153. In step 154, a tone generation mode is set.

In step 155, processing for changing tone source parameters of a tone source circuit is performed. In step 156, a top address indicated by phrase data (the phrase data memory 33 in FIG. 2) corresponding to the phrase number is set.

Thereafter, ROM data are read out in step 157. In step 158, first step time data is set, and in step 159, a phrase play time-base counter is cleared.

FIG. 13 is a flow chart showing phrase PB processing. In this case, if it is determined in step 200 that the count value of the time-base counter coincides with a step time, the read address is set (step 201), and note data for four bytes are read out from the ROM 20 (step 202).

In step 203, it is checked if the readout note data is a repeat mark. If YES in step 203, repeat processing is performed in step 204, and thereafter, the flow returns to the node before step 200.

If it is determined in step 203 in the flow chart of FIG. 13 that the readout data is normal note data, the flow advances to step 205 in the flow chart of FIG. 14 to set a tone generation mode.

It is then checked in step 206 if an auto-accompaniment mode is set. If YES in step 206, a key number is set in step 207. The flow then advances to step 208 to fetch a velocity value in phrase note data into the A register, and to fetch a velocity value of a key operation into the B register. Note that data to be stored in the B register at this time is a recorded key velocity when recorded data is played back.

In step 209, the phrase velocity and the key velocity value are multiplied with each other, thereby generating 16-bit data C, as described above.

In step 210, upper 8 bits of the 16-bit data C are extracted, and are doubled if necessary. In step 211, the extracted 8-bit data is used as tone generation velocity data.

The flow advances to step 212 to set a gate time. In step 213, tone generation processing of corresponding notes is performed. Upon completion of the tone generation processing, the read address is advanced by four bytes in step 214, and note data of a phrase to be generated next are read out from the ROM 20 in step 215. In step 216, the next step time is set in the buffer, and the flow then returns to step 200 in the auto-play routine shown in FIG. 13. Thereafter, the above-mentioned processing is repeated to sequentially generate phrase play notes.

The phrase play apparatus of the present invention comprises note data storage means for storing note data strings of a plurality of different short phrases in correspondence with key numbers. The note data string of the short phrase corresponding to a key number in key-ON data played back from recording/playback means is read out from the note data storage means. In addition, key depression strength data in the playback key-ON data is multiplied with tone generation strength data in the note data string read out from the note data storage means to obtain a modified note data string. Phrase tones are generated on the basis of the modified note data string.

Therefore, according to the present invention, since the tone volume of playback adlib phrase play tones can be varied according to the key-ON strengths, even a beginner can easily perform an adlib phrase play with a full range of expressions with one finger. When this adlib phrase key-ON data is recorded and played back, even if the playback adlib phrase key-ON data is mixed with playback normal key-ON data, a playback play operation close to an actual play can be performed without uneasy feeling.

What is claimed is:

1. An auto-play apparatus comprising:

note data storage means for storing note data strings of a plurality of different short phrases corresponding to a plurality of key numbers, each of the plurality of short phrases including a series of tones of a plurality of bars per phrase for one of rhythm, chord, melody, or combination thereof;

tone generating means for generating tones based on the note data strings stored in said note data storage means;

recording/playback means for recording key-ON data, including key number data and key-ON strength data;

means for reading a note data string of one of the plurality of short phrases corresponding to the key number data in the key-ON data played back by said recording/playback means; and modification means for multiplying tone generation strength data of the note data string read out from said note data storage means with the key-ON strength data of the key-ON data played back by said recording/playback means to obtain a modified note data string, and supplying the modified note data string to said tone generation means.

2. The apparatus of claim 1, wherein said modification means further multiplies the modified note data string by a predetermined, compensation factor to produce compensated tone generation strength data which is supplied to said tone generation means.

3. The apparatus of claim 1, wherein said recording/playback means records a mark indicating a play operation of the one of the plurality of short phrases together with the key-ON data.

4. The apparatus of claim 1, further comprising detecting means for detecting a mark indicating a play operation of the one of the plurality of short phrases, and when the mark is detected, the note data string of the one of the plurality of phrases corresponding to the key number data in the key-ON data played back by said recording/playback means is read out from said note data storage means.

5. The apparatus of claim 1, further comprising a phrase data memory for storing the plurality of key numbers and a corresponding top address of the note data string of the plurality of phrases corresponding to the plurality of key numbers in said note data storage means.

6. An auto-play apparatus comprising:

recording processing means for receiving key-ON data including a key number, a step time, a gate time and a velocity, for receiving a phrase-ON mark and a phrase-OFF mark in a phrase play mode, and for recording the key-ON data and the phrase-ON mark and phrase-OFF mark;

playback processing means including, phrase mark detecting means for detecting the phrase-ON mark, outputting a playback key number and a key velocity, and outputting normal note data, phrase data memory means for receiving the playback key number and reading out a top address of auto-play data of a phrase corresponding to the playback key number, auto-play data memory means for receiving the top address, reading playback mode data including the key number, the step time, the gate time, and the velocity for notes constituting the phrase corresponding to the playback key number, and for reading a fixed velocity, multiplying means for multiplying the tone generation playback note data velocity by the fixed velocity to produce a key varied velocity; and tone generating means for generating playback adlib phrase play tones based on the normal note data, the playback note data, and the key-varied velocity.

7. The auto-play apparatus of claim 6, wherein the key-varied velocity is multiplied by a compensating factor.

* * * * *